US005706971A

United States Patent [19]

Taylor

[11] Patent Number: 5,706,971

[45] **Date of Patent: *Jan. 13, 1998**

[54] VERSATILE COMMERCIAL TRASH BIN LID ASSEMBLY

[76] Inventor: Craig V. Taylor, 22502 So. Summit Ridge Cir., Chatsworth, Calif. 91311

[ * ] Notice: The term of this patent shall not extend beyond the expiration date of Pat. No. 5,447,251.

[21] Appl. No.: 617,808

[22] PCT Filed: Oct. 7, 1994

[86] PCT No.: PCT/US94/11444

§ 371 Date: Mar. 20, 1996

§ 102(e) Date: Mar. 20, 1996

[87] PCT Pub. No.: WO95/10457

PCT Pub. Date: Apr. 20, 1995

Related U.S. Application Data

[63] Continuation-in-part of Ser. No. 134,408, Oct. 8, 1993, Pat. No. 5,447,251.

[51] Int. Cl.[6] ..... B65D 43/02

[52] U.S. Cl. ..... 220/523; 220/524

[58] Field of Search ..... 220/909, 254, 220/334, 343; 232/43.1, 44

[56] References Cited

U.S. PATENT DOCUMENTS

| | | | |
|---|---|---|---|
| 3,720,346 | 3/1973 | Cypher . | |
| 3,749,274 | 7/1973 | Mele et al. . | |
| 4,456,141 | 6/1984 | Pamment . | |
| 4,598,838 | 7/1986 | Zakrajsek . | |
| 4,771,940 | 9/1988 | Taylor . | |
| 4,964,523 | 10/1990 | Bieltvedt et al. . | |
| 5,033,520 | 7/1991 | Kuehmichel . | |
| 5,044,644 | 9/1991 | Duran et al. . | |
| 5,183,180 | 2/1993 | Hawkins et al. . | |
| 5,193,708 | 3/1993 | Prout et al. . | |
| 5,251,775 | 10/1993 | Kruzick et al. . | |
| 5,447,251 | 9/1995 | Taylor | 220/573 |

*Primary Examiner*—Joseph M. Moy
*Attorney, Agent, or Firm*—Oppenheimer Poms Smith

[57] ABSTRACT

A commercial trash bin (26) is fitted with a commercial trash bin lid (22), which has an opening in the front (23). A variety of interchangeable insert plates (80, 102, 140), may be mounted onto the lid to cover the opening. An insert plate (102) may be fixedly attached to the lid to completely close the opening, such that the lid may be used as a standard commercial trash bin lid. The insert plate (102) may alternatively be hinged to the lid and be spring-biased into a closed position. A user may push on the lid to rotate it open for inserting small objects into the bin without having to lift the full lid. Insert plates (80, 140) provide separate apertures, either for recyclable bottles and cans. Chutes (150) may be provided to direct material input through the opening (23), and a rain hood (160) may be mounted onto the lid to prevent rain from entering the opening.

37 Claims, 6 Drawing Sheets

FIG. 4
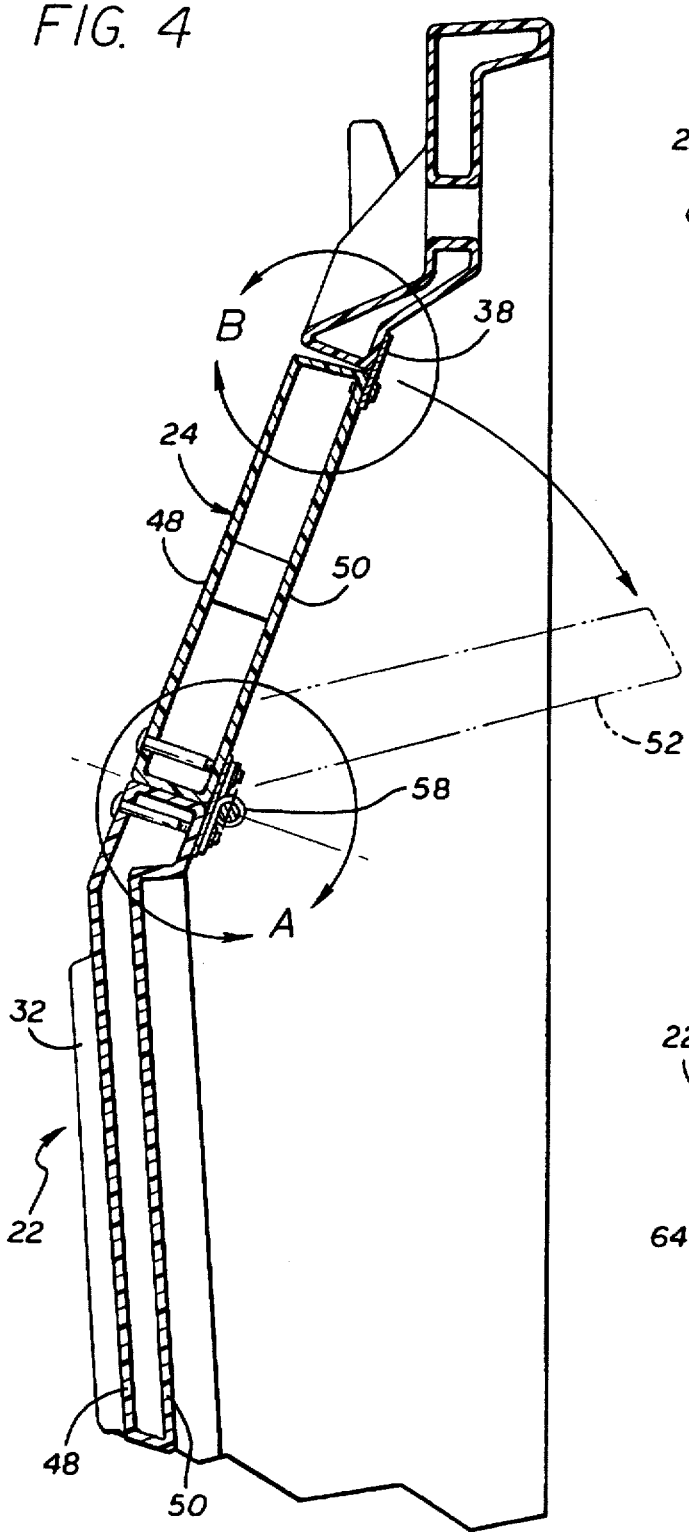
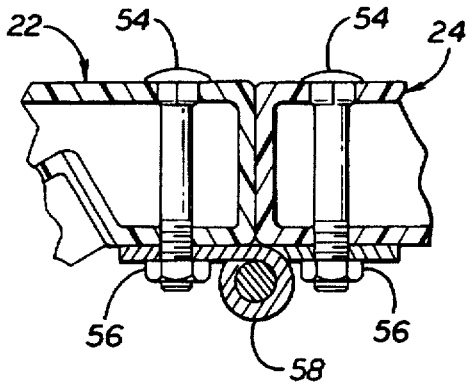
FIG. 4A
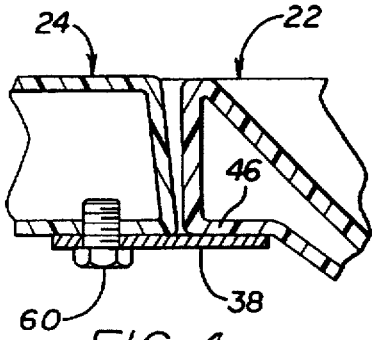
FIG. 4B
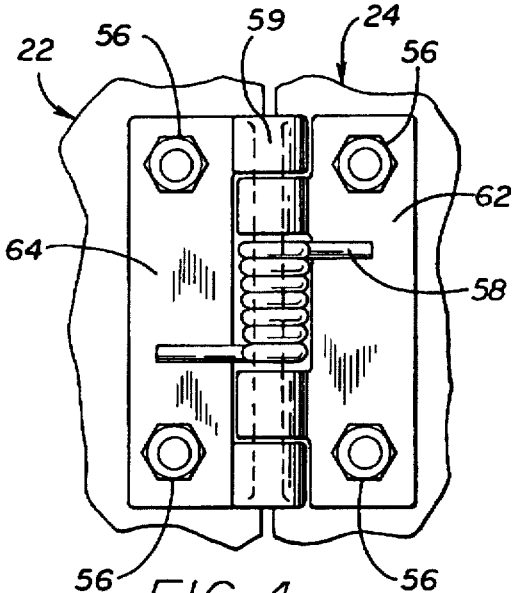
FIG. 4C

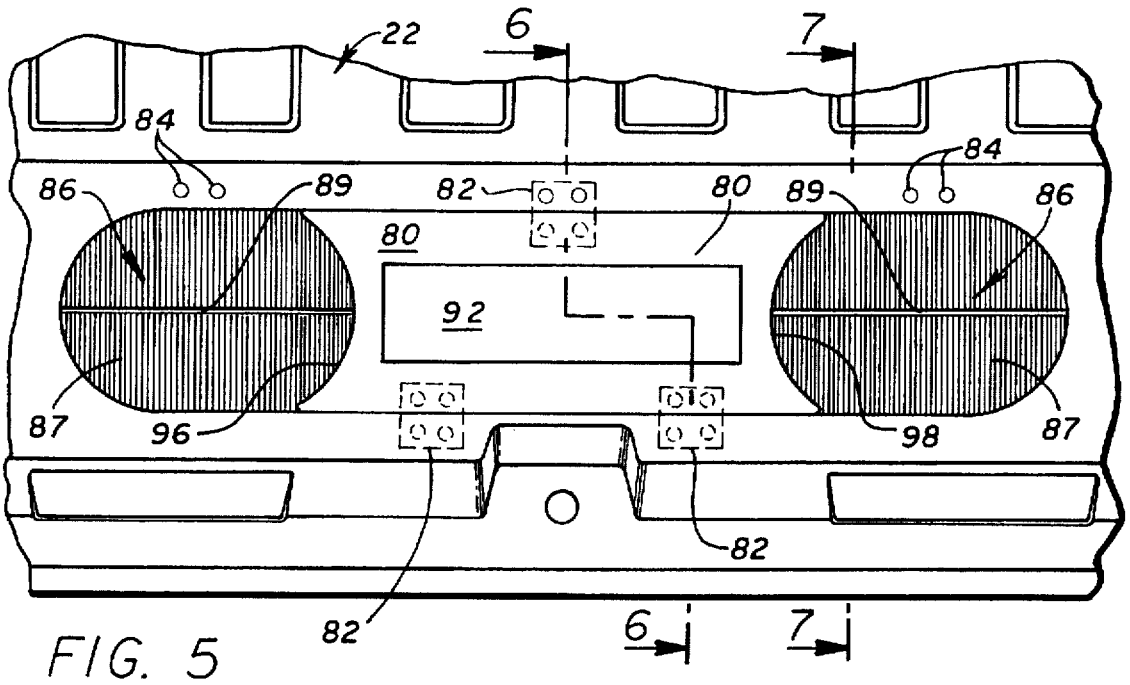
FIG. 5
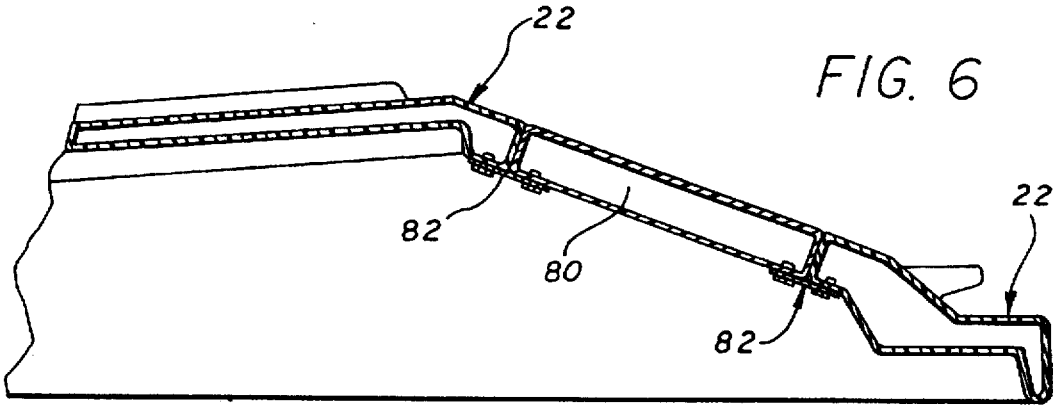
FIG. 6
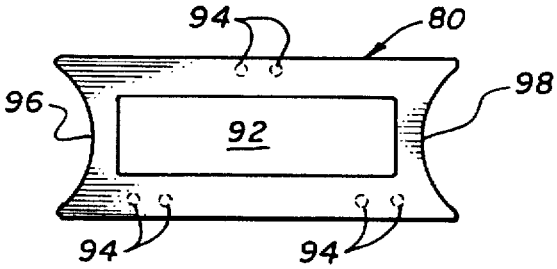
FIG. 8
FIG. 9
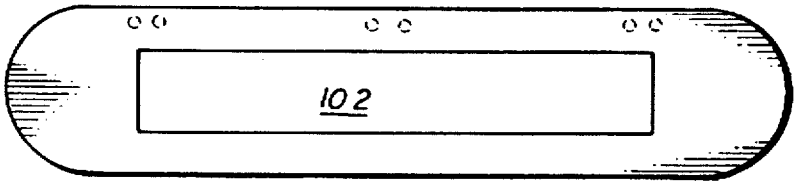

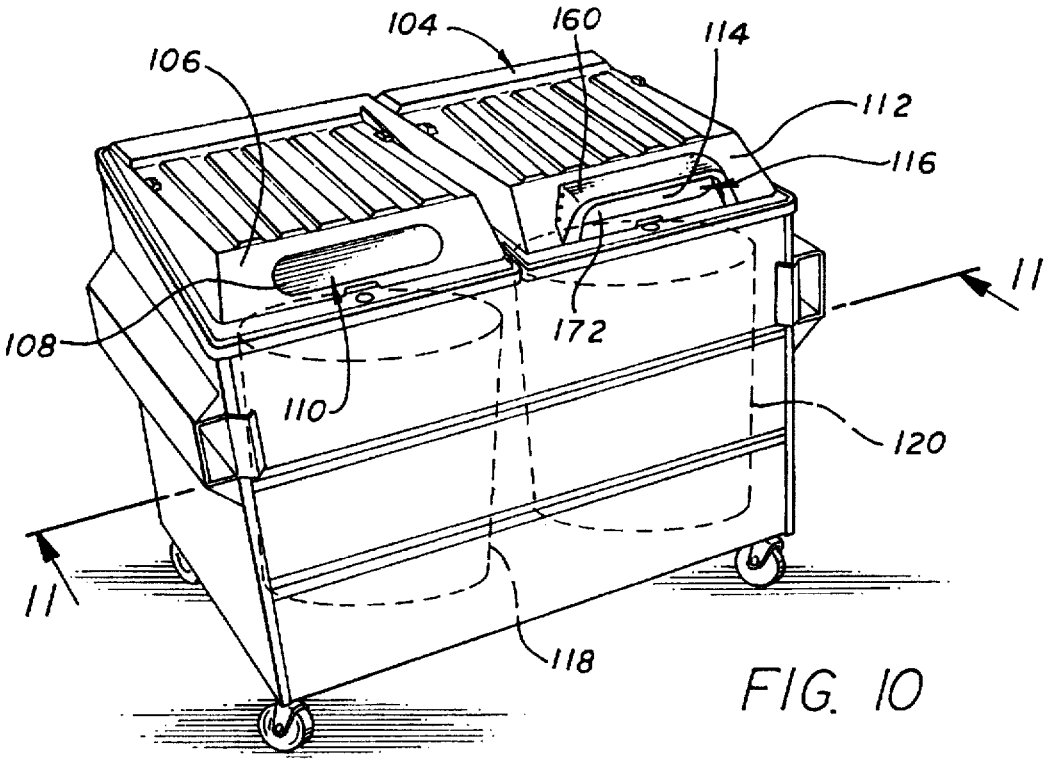
FIG. 10
FIG. 11
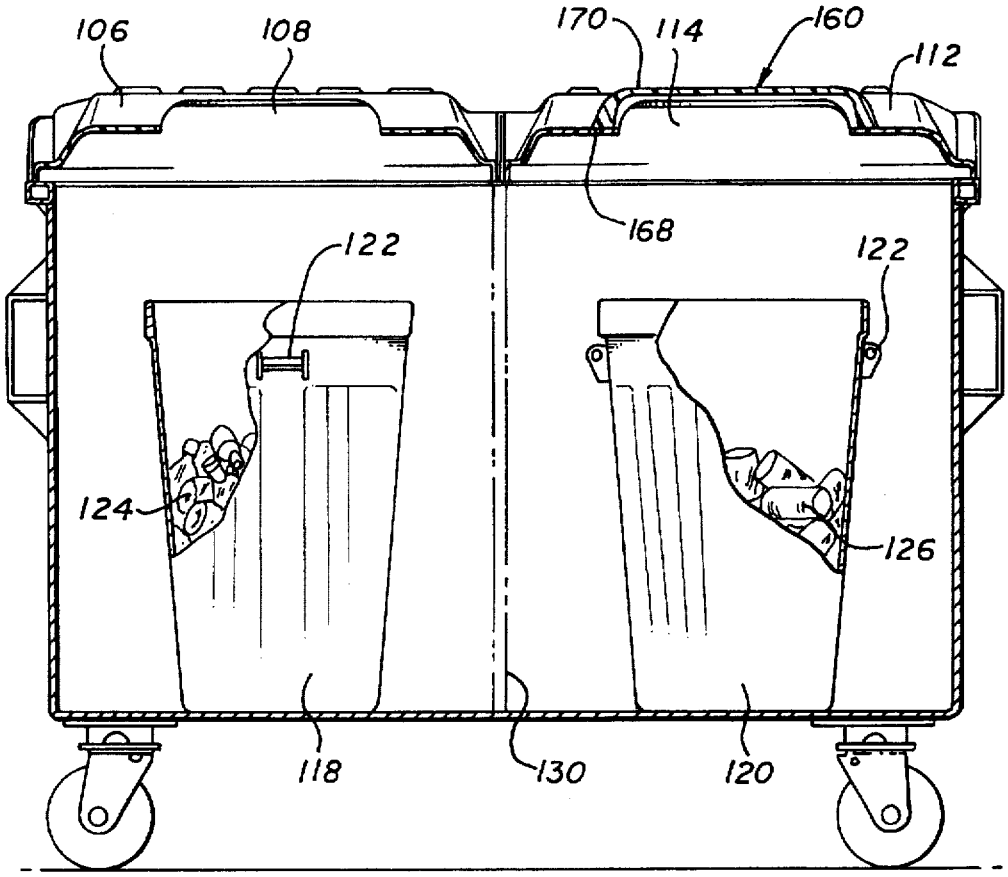

FIG. 7
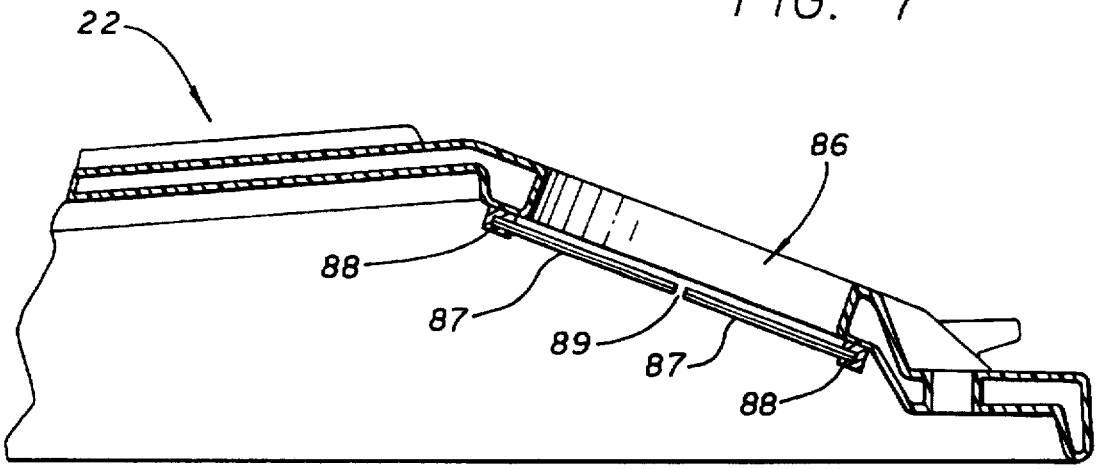
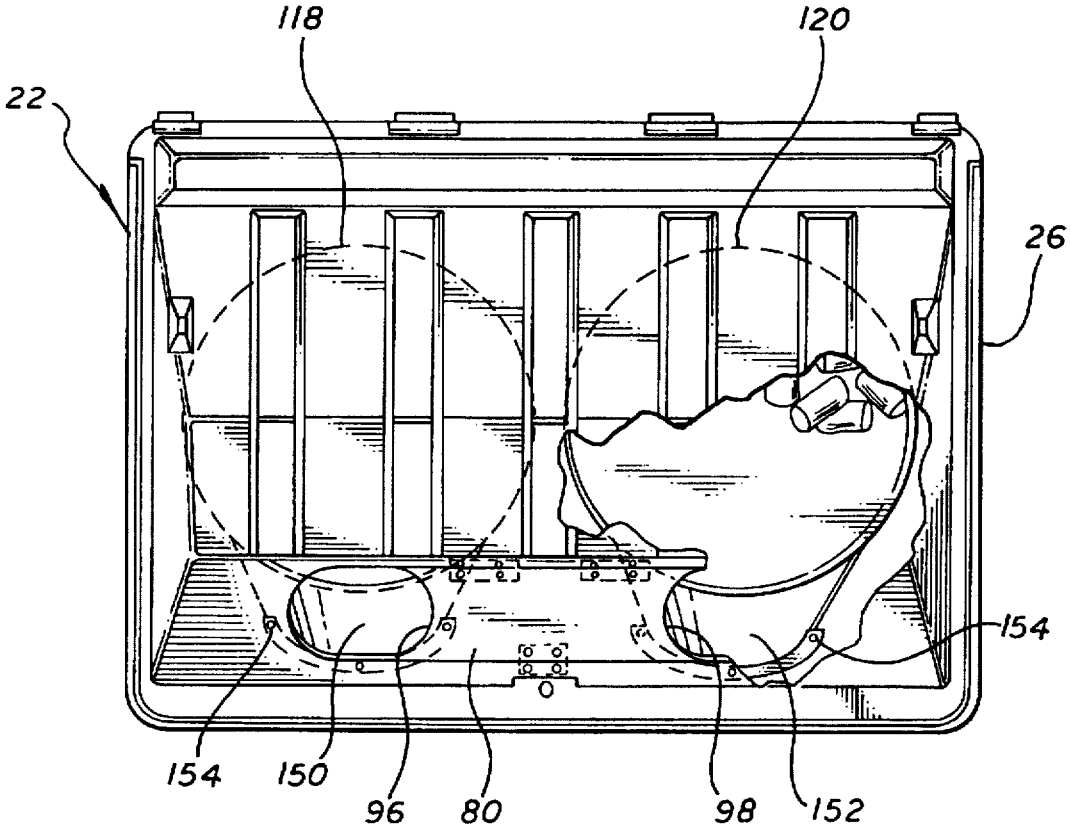
FIG. 13

VERSATILE COMMERCIAL TRASH BIN LID ASSEMBLY

RELATED APPLICATION

This is a continuation-in-part of U.S. patent application Ser. No. 08/134,408, filed on Oct. 8, 1993, now U.S. Pat. No. 5,447,251.

FIELD OF THE INVENTION

This invention relates to a versatile trash container lid assembly having interchangeable insert plates to easily and inexpensively convert the lid for a variety of different uses.

BACKGROUND OF THE INVENTION

Commercial refuse containers provide storage for substantial quantities of refuse prior to disposal at off-site locations such as landfills or incineration facilities. A typical commercial refuse container is a large, generally rectangular structure with an opening on top. One or more hinged lids swing down to cover the opening, thereby protecting the contents from the elements and preventing garbage odors from escaping.

A variety of commercial trash bin lids have been put into use to accommodate the needs of individual trash bin users. Some lids have been provided with an aperture to allow a user to dispose of small pieces of trash or recyclable material without having to lift the lid. The aperture has sometimes been covered by a small door, such as that disclosed in U.S. Pat. No. 4,456,141, issued to Pamment, which shows an aperture covered by a second lid.

Other lids provide more than one aperture so that a different type of recyclable material can be inserted into each aperture, thereby allowing easy segregation of the different materials. Yet another type of lid provides no open aperture, but does provide a fixed nameplate that displays the name of the owner of the containers.

The need to provide a variety of lids has created a problem for companies that lease commercial trash bin lids. When the lessee returns the bin to the company, the company must change the lid to meet the needs of the next user. So, for example, a county fair might need a fixed-nameplate lid for a few weeks. When the fair is over, the lessor may have to replace the fixed-nameplate lid with a lid having an aperture to meet the needs of an apartment complex that is renting the bin next. The constantly changing needs of the lessees force commercial trash bin lessors to maintain large and expensive inventories of lids. Similarly, an owner of an individual bin may have to pay for a new lid when he or she wants to put the bin to a new use.

SUMMARY OF THE INVENTION

In view of the expense of purchasing and storing various different lids for use on a commercial trash bin, the present invention provides a single commercial trash bin lid that can be easily and inexpensively converted to alter the use of the lid.

The lid preferably includes at least two different modes. In a first mode, the lid is provided with a fixed insert plate which may advertise the name of the owner or user of the lid. In one or more additional modes, the lid may have an aperture at least partially closed by a plate, which still permits the insertion of trash through the opening.

In one alternative mode, a user may swing the plate to open the aperture, so that the user may input a small piece of trash without lifting the lid. In a third mode, the geometry of the plate and the lid may provide two or more openings. A user can then input a different type of recyclable material into each opening. In addition to these different modes, the lid should be easily converted into various modes to accommodate various needs as they arise.

In accordance with illustrative specific preferred embodiments of the invention, a commercial trash bin lid is provided with a standard size opening toward the front thereof. A plurality of interchangeable, mating insert plates are provided which may selectively be fitted into the standard size opening to accommodate a variety of uses for the commercial trash bin lid. More specifically, an insert plate may be: (1) in the form of a fixed insert plate which may also be a nameplate; (2) a spring biased hinged insert plate to permit the insertion of newspapers or the like through the hinged insert plate; or (3) provided with at least two spaced openings to receive different types of trash, such as recyclable cans and bottles.

In accordance with another feature of the invention, the commercial trash bin may have an interior arrangement for separating trash. This arrangement may consist of partitions dividing the commercial trash bin into different regions. Alternatively, one or more inner containers may be provided inside the commercial trash bin. With either arrangement, one type of trash is readily separated from other types of trash.

In accordance with one aspect of the invention, a commercial trash bin lid which includes two spaced plastic layers may be provided with a standard sized opening toward the front of the lid, and the plastic layers may be molded to join each other around the opening to form a high strength smooth opening; and arrangements are provided for securing standard size insert plates to fit into the opening.

In accordance with another aspect of the invention, a commercial trash bin lid is provided with a standard size opening toward the front thereof; and alternative mating insert plates are provided which may selectively be fitted into the standard size opening to accommodate a variety of uses for the commercial trash bin and lid assembly.

Embodiments of the present invention may include various other features. The trash bin may have a minimum volume of at least 500 liters. The lid opening may be at least approximately 18 inches long. The assembly may include brushes that extend across the aperture to discourage pilfering. A rain hood that is adapted to mount onto the lid and to extend over the opening to prevent rain from entering said bin. One or more chutes may be mounted on the inner side of the lid, with the chute or chutes directing material deposited through the lid opening to a predetermined area of the bin. One or more of the insert plates may provide a plurality of spaced apertures to receive different types of recyclable material. One or more spring-biased hinges adapted to attach at least one of said insert plates to the commercial trash bin lid may be provided. The spring-biased hinge or hinges allow the insert plate to swing open for the deposit of trash, then return to a closed position.

As is readily seen, the interchangeable insert plates of the present invention allow a user to convert the commercial trash bin lid to accommodate a variety of uses. New insert plates can be developed to meet the needs of specific users as they arise.

Other objects, features, and advantages of the invention will become apparent from a consideration of the following detailed description and the accompanying drawings.

BRIEF DESCRIPTION OF THE DRAWINGS

FIG. 4 is a cross-sectional view taken along line 4—4 of FIG. 3 showing the swinging motion of the insert plate, which is mounted to the lid via a hinge and coil spring assembly;

FIG. 4A is an enlarged view of Section A of FIG. 4 showing the coil spring attached to the lid and the insert plate;

FIG. 4B is an enlarged view of Section B of FIG. 4 showing a stop attached at the lip of the insert plate to prevent the coil spring from pushing the insert plate too far open;

FIG. 4C is an enlarged view of the coil spring and the associated hinge attached to the lid and the insert plate;

FIG. 5 is a perspective view of an insert plate mounted onto the lid, the insert plate being provided with two spaced openings to receive different types of recyclable material, such as bottles and cans;

FIG. 6 is a sectional view taken along line 6—6 of FIG. 5 showing the double-walled construction of the lid and insert plate of FIG. 5, with the insert plate being fixedly attached to the lid;

FIG. 7 is a sectional view taken along line 7—7 of FIG. 5 showing the brushes mounted on the interior wall of the lid;

FIG. 8 is a view of the insert plate of FIG. 5;

FIG. 9 is a view of an alternative embodiment of a nameplate insert plate;

FIG. 10 is a perspective view of a commercial trash bin according to the present invention wherein two inner containers are provided for segregating recyclable material from other trash, and a rain hood extends over a universal access port;

FIG. 11 is a cross-sectional view of a commercial trash bin taken along line 11—11 of FIG. 10 showing one inner container storing recyclable glass bottles and another inner container storing recyclable aluminum cans;

FIG. 13 is a top view and partial cutaway view of an embodiment having chutes to guide recyclable material to desired positions within the bin.

DETAILED DESCRIPTION OF THE PREFERRED EMBODIMENTS

Figure 1:
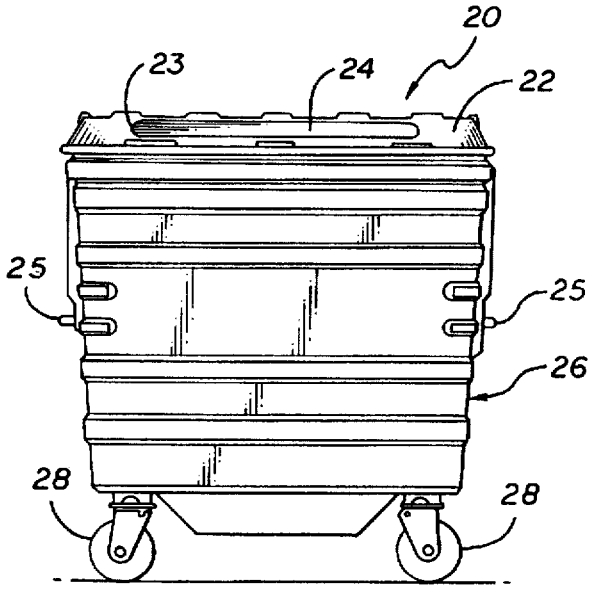
FIG. 1 is a front view of an embodiment of a commercial trash bin assembly in accordance with the present invention.
Figure 2:
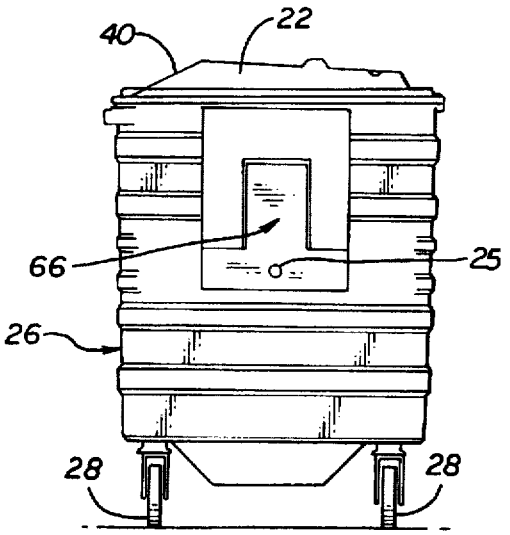
FIG. 2 is a side view of the commercial trash bin assembly of FIG. 1.

Referring more particularly to the drawings, FIG. 1 shows a commercial trash bin assembly 20 according to the present invention. Assembly 20 includes a commercial trash bin lid 22 mounted on a commercial trash bin 26. Lid 22 includes an opening 23 in the front portion of the lid. An insert plate 24 covers the opening 23. Commercial trash bin 26 is provided with wheels 28 for mobility. FIG. 2 is a side view of the commercial trash bin assembly 20. The commercial trash bin is provided with handle 66, and two outwardly extending pivot pins 25 which allow a mechanized truck to lift the entire commercial trash bin and pivot it about pins 25 to empty its contents. The front portion 40 of lid 22 slopes forward toward the front of the commercial trash bin. As will become apparent, this forward sloping aids the user in disposing of small articles of trash through opening 24.

Figure 3:
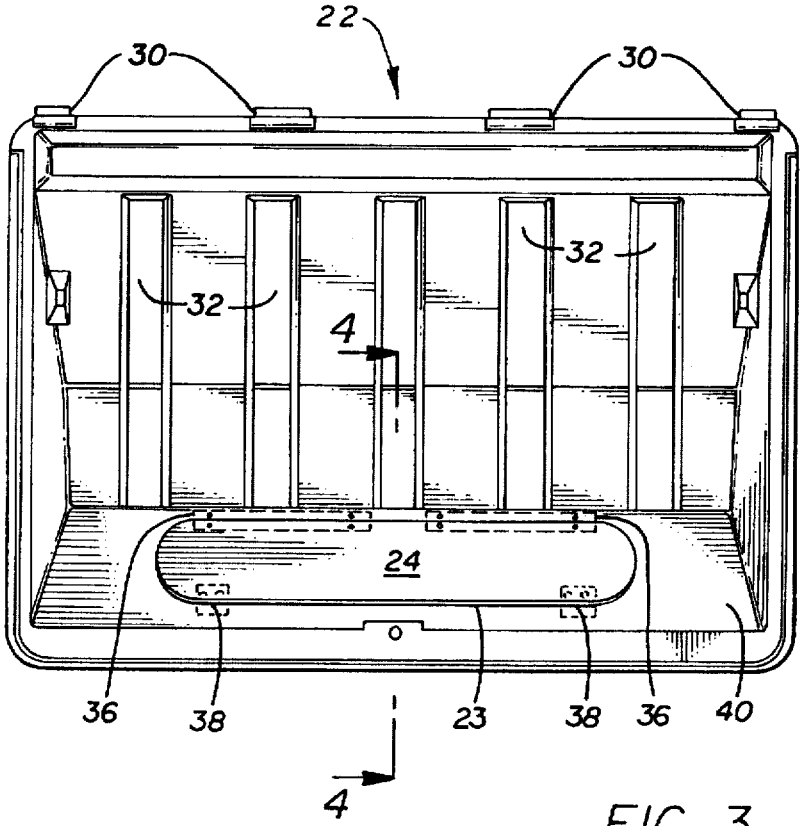
FIG. 3 is a top view of the commercial trash bin lid shown in FIG. 1 showing that the lid is provided with a front opening and an insert plate hingedly mounted to the lid and covering the front opening.

FIG. 3 shows the commercial trash bin lid 22 in some detail. Ribs 32 stiffen the lid to prevent the lid from sagging. FIG. 10 shows that ribs 32 may be raised above the surface of the commercial trash bin lid. Returning to FIG. 3, hinges 30 attach to a hinge rod (not shown) on the rear of the commercial trash bin, thereby rotatably securing the lid to the commercial trash bin. The front portion 40 of lid 22 is provided with opening 23, which is covered by insert plate 24. Coil spring plates 36 connect insert plate 24 to lid 22. Stop plates 38 prevent insert plate 24 from opening outwardly from the commercial trash bin, but allow the insert plate to open inwardly into the commercial trash bin.

FIG. 4 is a cross-sectional view of the lid assembly taken along line 4—4 of FIG. 3. It is important to note that lid 22 and insert plate 24 may have a "double-walled" construction. That is, lid 22 and insert plate 24 have an upper wall 48 and a lower wall 50. This double-wall construction provides additional structural support for the lid. Thus, the lid can be made of a lightweight material, such as a cross-linked polymer, without experiencing sag. This type of double-walled, cross-linked polymer lid is particularly tough and retains its normal shape even after being repeatedly impacted. An example of a double-walled refuse container cover is provided in U.S. Pat. No. 4,771,940, which is incorporated by reference.

FIG. 4 also shows that coil spring 58 in region A spring biases insert plate 24 into a closed position. Consequently, when the insert plate is rotated clockwise into open position 52, the coil spring will create a force to rotate the insert plate counterclockwise.

FIG. 4A is a close-up, cross-sectional view of Section A in FIG. 4. FIG. 4C is a bottom view of the structure of FIG. 4A. As seen in these figures, spring plate 64 is bolted onto lid 22, and spring plate 62 is bolted onto insert plate 24. Both spring plates are mounted onto shaft 59 so as to allow insert plate 24 to rotate relative to lid 22. Coil spring 58 is mounted onto shaft 59, located between spring plates 62 and 64.

FIG. 4B is a close-up, cross-sectional view of Section B in FIG. 4. Stop plate 38 is bolted onto the edge of insert plate 24. Stop plate 38 extends beyond the edge of insert plate 24 to engage with the front portion of lid 22 when the insert plate is closed. FIG. 3 shows that two short stop plates may be employed, although a third stop plate may be added in between the other two.

FIGS. 5 and 7 illustrate an alternate embodiment of an insert plate 80. The insert plate has curved, concave edges 96 and 98 and is considerably shorter than opening 23. Consequently, apertures 86 are formed at either end of insert plate 80. This allows a user to insert different types of recyclable material in either aperture, or to distribute one recyclable material more evenly to more completely fill the container. For instance, a user might insert glass bottles in one aperture and aluminum cans in the other. A region 92 is provided on insert plate 80 for imprinting a corporate name and logo or other indicia, as well as the name of the recyclable material to be deposited, or instructions for use. A similar imprint region 102 may be provided on a larger insert nameplate of the type shown in FIG. 8.

Returning to FIG. 5, insert plate 80 is fixedly mounted onto commercial trash bin lid 22. FIG. 6, which is a cross-sectional view taken along line 6—6 of FIG. 5, shows that insert plate 80 is bolted onto lid 22 so that a user cannot rotatably open the insert plate. Alternatively, the insert plate may be mounted onto lid 22 with a coil spring arrangement such as that shown in FIG. 4C.

Embodiments having an insert plate such as 80 may include brushes 87, which serve to discourage pilfering by making it more difficult for someone to reach inside the trash container and remove recyclable objects. Brushes 87 also prevent loose paper and other unwanted trash from blowing into the apertures 86. The brushes 87 may be mounted as illustrated in FIG. 7, in which brush retention slots 88 are provided on the interior side of the lid, adjacent to the top and bottom edges of the apertures 86. The bristles of the brushes extend partially across the apertures 86. Cans, bottles, or other recyclable items may then be inserted in between the line of separation 89 between two opposing rows of bristles, as seen in FIGS. 5 & 7.

FIG. 10 illustrates an alternative embodiment 104 of the present commercial trash bin assembly. This embodiment includes two separate lids 106 and 112 having front openings 108 and 114, respectively. This dual-lid arrangement is particularly appropriate for larger commercial trash bins. Insert plates 110 and 116 are mounted onto the respective lids by the spring bias arrangement illustrated in FIGS. 4 and 4A–C. Free-standing inner containers 118 and 120 are positioned inside the commercial trash bin, directly behind and below front openings 108 and 114, respectively.

As seen in FIG. 11, a user may insert recyclable materials into openings 108 and 114 for storage in inner containers 118 and 120. FIG. 11 shows that inner container 118 contains glass bottles 124, while inner container 120 contains aluminum cans 126. Handles 122 are provided on containers 118 and 120 to allow a user to lift the containers out of the commercial trash bin to remove the recyclable materials. A mechanized truck can then lift and empty the commercial trash bin in standard fashion.

Dashed lines 130 in FIG. 10 show that the trash container 104 may be partitioned into two compartments, with one type of recyclable material being deposited in one compartment and another type being deposited in the other. The containers may be emptied by mechanized dumpers either using a single truck with a split receiving hopper, or by unlocking one of the lids and then the other as the container is dumped successively by two trucks, one for each type of recyclable material.

The interchangeable insert plates that FIGS. 3, 7, and 8 illustrate are a key feature of the present invention. These insert plates make the lids of the present invention very versatile. For example, a user may wish to utilize the spaced aperture insert plate 80 of FIG. 7 to separate recyclable bottles and cans from each other. At a later time, the user can convert the lid for recycling newspapers, for instance, by replacing insert plate 80 with spring-biased insert plate 24. At yet another time, the user may replace insert plate 24 with a nameplate insert that completely covers opening 23 and is fixedly attached to lid 22, thereby creating a standard lid. This versatility spares a user the considerable cost of having to purchase several separate lids. A wide variety of insert plates, each having a unique feature can easily be developed to meet specific user needs.

A lid "kit" according to the present invention (FIG. 12) may include a variety of components, such as a lid 22 having a universal access port 23, various insert plates 80, 102, 140 that may be individually mounted within the universal access port, a chute 150 or chutes to direct objects within the bin, spring hinges 36, plates 82, nuts, bolts, and/or screws 60 of various sizes, and possibly other hardware. When mounted on the lid, insert plate 140 provides three apertures through which recyclable material may be input. Concave end portions 144 provide two such apertures, and aperture 142 provides the third.

Figure 12:
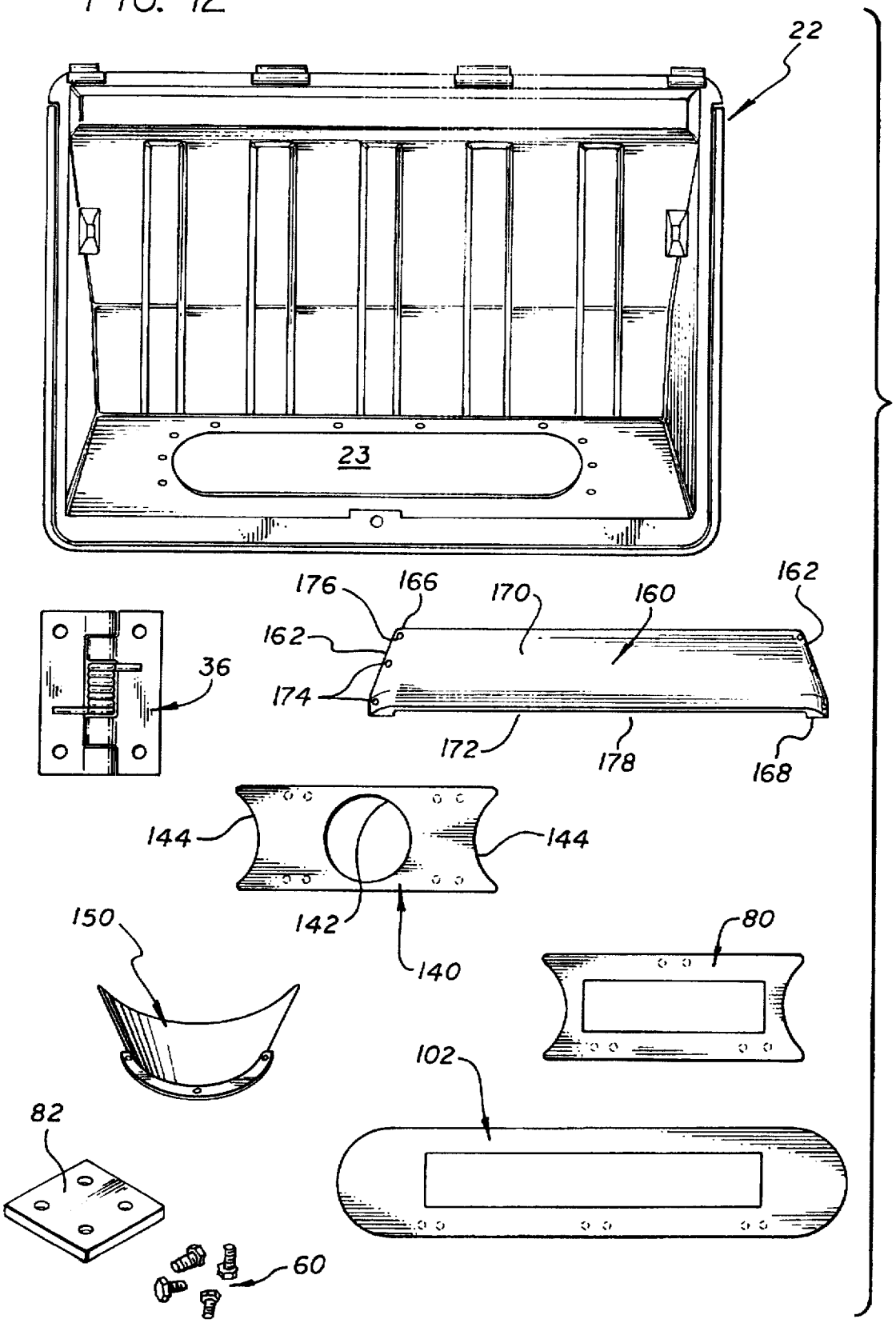
FIG. 12 shows a kit that includes a trash bin lid with a universal access port, various insert plates, one or more chutes, one or more spring hinges, bolts, and one or more plates and a rain hood.

A kit such as that shown in FIG. 12 allows the user to configure the lid as she desires. For instance, the user may fixedly mount an insert plate 80, 102, or 140 using a plurality of plates 82 and an appropriate number of screws, nuts and/or bolts 60. Alternatively, the user may hingedly mount an insert plate 80, 102, or 140 with one or more spring hinges 36 and an appropriate number of screws or nuts and bolts. The user may also mount one or more chutes 150 on the interior wall of the lid 22, such that the chute or chutes directs deposited bottles or cans into specific areas of the interior of the bin. Various other components may be added to the kit, depending on the needs of the user.

A rain hood 160 may be provided to prevent rain from entering the opening 23, which may also be referred to as a universal access port. Rain hood 160 has two sides 162 each having an upper end 166 and a lower end 168, with bolt apertures 174 on the lower end. The top 170 of the rain hood extends between upper ends 166 of the sides 162 and backward to define the rear 164 of the rain hood. The hood 160 is mounted about the universal access port 23, with the top portion of the hood extending over access port 23 and with an open front 172 allowing access to the access port. Hood 160 is bolted onto the lid 22 at side bolt apertures 174 and rear bolt apertures 176. An optional rain flap 178 may extend downwardly from the rain hood to cover the open front 172 of the hood, thereby preventing rain from blowing into the access port.

One or more chutes 150 (FIG. 13) may be provided to guide inserted items into the proper areas of the interior of the bin. One such arrangement includes an insert plate 80 having concave end portions 96, 98 to provide apertures 86 for bottles or cans when mounted on lid 22. Chutes 150, 152 are mounted on the interior lid wall and the insert plate, which is normally fixedly mounted to the lid, by means of a flange/bolt/nut arrangement. The chutes are bolted onto the interior lid wall through bolt apertures 154. Chutes 150, 152 extend downwardly and inwardly into the bin 26, thereby directing objects entering apertures 86 into receptacles 118, 120, respectively.

Other chute arrangements may alternatively be provided. For instance, an insert plate may be provided such as insert plate 80 of FIG. 12 which, when mounted, provides three or more apertures for inserting bottles or cans. Three chutes may then be provided, with one chute for each of the apertures.

Chutes 150 may be provided to separately direct recyclable items to various positions within the interior of the bin. For instance, one chute may direct all objects that are inserted into one aperture to the rear of the bin. Another chute may direct all objects that are inserted into a second aperture to the front right of the bin. Still another chute may direct objects inserted into a third aperture to the front left of the bin. The general idea is to provide chutes that are individually associated with a corresponding aperture to direct objects inserted into the aperture to a particular location within the bin. One chute may direct all glass bottles to a glass bottle area, another chute may direct all aluminum cans to a can area, and so on. An individual receptacle may be positioned beneath the end of each chute.

In the preferred embodiment, the refuse container lid of this invention is manufactured from an organic polymer such as a polyethylene resin which is cross-linked and manufactured using conventional rotational molding techniques. Among the materials available are cross-linked HDPE compounds of polyethylene resins as manufactured by the Phillips Chemical Company of Bartlesville, Okla. under the registered trademark Marlex. Similar suitable materials are available from the PAXON company.

While a cross-linked polyethylene material is preferably used to manufacture the lid of the present invention, a variety of polyethylenes may be used including linear low-density polyethylites. The nature of the organic polymer is preferably such that it has thermal setting characteristics. However, included within the materials which may be used to manufacture the cover of this invention are thermoplastic materials such as vinyl, polyethylene, and polypropylene.

The refuse container lids are preferably formed by a rotational molding process. Rotational molding is known per se, and involves closing two metal mold halves and clamping these together. Heat is applied to the mold at a controlled temperature, while the mold is rotated simultaneously about two axes, with powdered plastic particles within the mold. The tumbling plastic particles melt and gradually fuse to form a homogenous layer of substantially uniform thickness over the entire inner surface of the mold. A hollow article having a substantially continuous outer surface is thus formed. The refuse container lids could be formed by other techniques, such as by forming the upper and lower surfaces separately, and bonding them together along their peripheries by blow molding or any other hollow part molding process; however, the rotational molding, or roto-molding process is preferred.

The rain hoods, chutes and insert plates of the present invention may be made of the same material as the lids, or may be a variety of other durable materials. The insert plates may be double-walled and may be manufactured with a rotational molding or blow molding process.

The lids may have a raised upper surface, and a mating recessed lower surface so that the lids may be stacked in a nested or interfitting manner. To give the general idea of dimensions, a typical commercial trash bin lid as used in the United Kingdom may be 1235 mm wide by 920 mm deep by 27 mm thick. An insert plate of the type illustrated in FIG. 8 may be 750 mm wide by 148 mm deep by 27 mm thick. The rounded edges of the removable plate may be portions of circles having radii of 74 mm. A typical commercial trash bin may be 1370 mm high by 1275 mm wide by 980 mm deep.

The approximate minimum commercial trash bin volume for the present invention is about 500 liters. Incidentally, a typical small commercial trash bin of the type widely used in the U.S. and as shown in FIGS. 9 and 10, may be about six feet long and three feet from front to back. It is anticipated that a typical lid opening will be at least approximately 30 inches in its longer direction for large commercial trash bins, corresponding to the 750 mm figure noted above. More generally, the opening should be at least 12 inches, and preferably at least 18 inches, in its longer direction so that a standard-size newspaper will fit through the opening. It should be stressed, however, that specific dimensions vary widely depending on the particular embodiment and on the particular country for which it is intended.

While a particular preferred embodiment has been disclosed, it will be understood that variations and modifications may be effected without departing from the spirit and scope of the invention. Thus, by way of example and not of limitation, lid 22 may have a single-layer construction using aluminum, steel or other metal. Additionally, a wide variety of plastics known to those skilled in the art may be used for all of the components of the present invention rather than cross-linked polymers. As with the lids, the chutes 150 and rain hood 160 may be made from various alternative materials, including aluminum, steel or other metals, or durable composite materials, for example.

A commercial trash bin may be provided with three or more lids rather than the one or two illustrated in the drawings. Compartments may be built into the commercial trash bin to separate the recyclable materials and trash, rather than removable inner containers. The commercial trash bin need not be rectangular, but may be circular or any other shape, and is not limited to any particular dimension. Similarly, the lid openings and associated insert plates may be a variety of different shapes, including rectangular, oval, circular, or various irregular shapes adapted for a particular purpose. The insert plates need not be flat, but may be arched or have a bent-like configuration, with one portion of an insert plate lying within one plane and an adjacent portion lying in another plane. Furthermore, the insert plates may be double walled as shown in FIGS. 4 and 6, or otherwise multi-walled, or may be a single layer of material More generally, the term insert may refer to brushes or flaps alone.

The lids may have several openings rather than just one, and the openings may be located anywhere on the lid. With reference to FIG. 5, rubber flaps may be used as an alternative to the brushes 87 to discourage pilfering. Spring hinge 36 may be longer than that illustrated in the FIG. 4C and may have two or more coil springs.

The chutes 150 may be mounted in various ways, and the present invention is not limited to the mounting arrangement illustrated in FIG. 13. For instance, the chutes may be mounted on the front wall of the bin, rather than on the lid itself. The insert plate could then be mounted onto the lid with a spring hinge, allowing the insert plate to swing open without interference from the chutes.

Accordingly, the present invention is not limited to the specific embodiment shown in the drawings and described in the detailed description.

What is claimed is:

1. A commercial trash bin assembly comprising:

a commercial trash bin;

a double-walled plastic commercial trash bin lid covering an open top of the bin and having a front portion and a standard-sized opening in the front portion, said lid comprising two spaced layers of material, said layers being molded to Join each-other around said opening to form a smooth, high-strength perimeter; and a plurality of interchangeable insert plates, each being separately mountable on said lid to be received into said lid opening, said assembly further including at least a first insert plate which is adapted to completely close said lid opening, and a second insert plate which is adapted to only partially close said lid opening, and said second insert plate being adapted to form at least one aperture within the periphery of said lid opening when mounted on said lid;

wherein said trash bin lid may be converted quickly and inexpensively without removing the lid from the container by removing one of said insert plates and replacing it with another of said insert plates, for use in recycling an entirely different recyclable commodity.

2. A commercial trash bin assembly as defined in claim 1, wherein said insert plates are double-walled plastic.

3. A commercial trash bin assembly as defined in claim 1, wherein said lid opening has a longer dimension, and said longer dimension is least approximately 18 inches.

4. A commercial trash bin assembly as defined in claim 1, wherein said assembly further comprises brushes extending across said aperture when said second insert plate is mounted on said assembly, wherein said brushes discourage pilfering of said bin.

5. A commercial trash bin assembly as defined in claim 1, wherein said assembly further comprises a rain hood adapted to mount onto said lid and to extend over said opening to prevent rain from-entering said bin.

6. A commercial trash bin assembly as defined in claim 1, wherein said lid comprises an inner side and an outer side, and wherein said assembly further comprises a chute mounted on said inner side of slid lid, said chute directing material deposited through said opening to a predetermined area of said bin.

7. A commercial trash bin assembly as defined in claim 1, Wherein said assembly further comprises at least one inner container positioned within said bin.

8. A commercial trash bin assembly as defined in claim 1, wherein said second insert plate is adapted, when mounted on said lid, to provide a plurality of spaced apertures to received different types of recyclable material.

9. A commercial trash bin assembly as defined in claim 1, wherein said assembly includes a spring-biased hinge adapted to attach at least one of said insert plates to said commercial trash bin lid so that said insert plate may swing open to allow a user to input recyclable material through the opening in the commercial trash bin lid.

10. A commercial trash bin assembly as defined in claim 1, wherein one of said insert plates is securely mounted to said lid.

11. A commercial trash bin lid assembly comprising:

a commercial trash bin lid having a front portion, the commercial trash bin lid having a standard-sized opening in the front portion;

said lid having an extent of at least three feet in at least one direction; and a plurality of interchangeable insert members of different configurations, each of which is adapted to be individually fitted to said lid to be received into and at least partially close said opening;

wherein said trash bin lid may be converted quickly and inexpensively without removing the lid from the container by removing one of said insert members and replacing it with another of said insert members, for use in recycling an entirely different recyclable commodity.

12. A commercial trash bin assembly-as defined in claim 11, wherein said assembly further comprises brushes extending across a portion of said opening to discourage pilfering.

13. A commercial trash bin assembly as defined in claim 11, wherein said assembly further comprises a rain hood adapted to mount onto said lid and to extend over said opening to prevent rain from entering said bin.

14. A commercial trash bin assembly as defined in claim 11, wherein said lid comprises an inner side and an outer side, and wherein said assembly further comprises a chute mounted on said inner side of said lid, said chute directing material deposited through said opening to a predetermined area of said bin.

15. A commercial trash bin assembly as defined in claim 11, wherein said assembly further comprises at least one inner container positioned within said bin.

16. A commercial trash bin assembly as defined in claim 11, wherein at lest one of said insert plates is adapted, when mounted on said lid, to provide a plurality of space apertures to received different types of recyclable material.

17. A commercial trash bin lid assembly as defined in claim 11, wherein at least one of said insert plates is adapted, when mounted on said lid, to provide an aperture to receive refuse.

18. A commercial trash bin assembly as defined in claim 11, wherein said assembly includes a spring-biased hinge adapted to attach at least one of said insert plates to said commercial trash bin lid so that said insert plate may swing open to allow a user to input recyclable material through the opening in the commercial trash bin lid.

19. A commercial trash bin lid assembly as defined in claim 11, wherein at least one said insert plates is adapted to fully close said opening and wherein said assembly includes arrangements for fixedly securing said insert plate to said lid so that said opening remains closed during normal use of said lid.

20. A commercial trash bin lid assembly as defined in claim 11, wherein said insert plates are substantially flat and elongated.

21. A large commercial trash bin assembly comprising:

a large commercial trash bin having a minimum volume of at least 500 liters and an open top;

a commercial trash bin lid made substantially of molded plastic covering at least a part of the open top of said trash bin, said trash bin lid having a front portion and an opening in the front portion;

a plurality of interchangeable inserts, each being adapted to be mounted on said lid and to be received into and at least partially close said opening, said opening being at least approximately 18 inches wide; and at least one removable inner container having dimensions substantially less than said commercial trash bin, the container being positioned inside of said commercial trash bin and below said opening of said lid;

wherein at least one of said inserts is adapted to fully close said opening and to be fixedly secured to said lid so that said opening would remain closed during normal use of said lid;

whereby said trash bin lid may be converted quickly and inexpensively without removing the lid from the container by removing one of said inserts and replacing it with another of said inserts, for use in recycling an entirely different recyclable commodity.

22. A commercial trash bin assembly as defined in claim 21, wherein said assembly includes a spring-biased hinge adapted to attach one of said insert plates to said commercial trash bin lid so that said insert plate may swing open to allow a user to input refuse through the opening in the commercial trash bin lid, said hinge being adapted to tend to push said mounted insert plate back into a closed position.

23. A commercial trash bin assembly as defined in claim 21, wherein one of said insert plates is adapted for mounting on said lid to provide an aperture to receive bottles and cans.

24. A commercial trash bin assembly as defined in claim 21, wherein said assembly further comprises means extending across at least a portion of said opening to discourage pilfering.

25. A commercial trash bin assembly as defined in claim 21, wherein said assembly further comprises a rain hood adapted to mount onto said lid and to extend over said opening to prevent rain from entering said bin.

26. A commercial trash bin assembly as defined in claim 21, wherein said assembly further comprises a chute mounted on said lid, said chute directing material deposited through said opening into said removable inner container.

27. A commercial trash bin lid assembly comprising:

a commercial trash bin lid having a standard-sized opening;

said lid having an extent of at least approximately three feet in at least one direction; and a plurality of interchangeable insert members of different configurations, each of which is adapted to be individually fitted to said lid to at least partially close said standard-sized opening;

wherein said trash bin lid may be converted quickly and inexpensively without removing the lid from the container by removing one of said insert members and replacing it with another of said insert members, for use in recycling an entirely different recyclable commodity.

28. A commercial trash bin assembly as defined in claim 27, wherein said assembly further comprises brushes extending across at least a portion of said opening to discourage pilfering.

29. A commercial trash bin assembly as defined in claim 27, wherein said assembly further comprises a rain hood which may be integral to the lid, or which may alternatively be adapted to mount onto said lid, for extending over said opening to prevent rain from entering the trash bin.

30. A commercial trash bin assembly as defined in claim 27, wherein said assembly further comprises a chute for mounting on said lid to direct material deposited through said opening into the trash bin.

31. A commercial trash bin assembly as defined in claim 27, wherein said assembly further comprises at least one inner container positioned within the trash bin.

32. A commercial trash bin assembly as defined in claim 27, wherein at least one of said insert members is adapted, when mounted on said lid, to provide a plurality of spaced apertures to receive different types of recyclable material.

33. A commercial trash bin assembly as defined in claim 27, wherein said trash bin lid is double-walled and plastic.

34. A commercial trash bin assembly as defined in claim 27, wherein said assembly includes a spring-biased hinge adapted to attach at least one of said insert members to said commercial trash bin lid so that said insert member may swing open to allow a user to input recyclable material through the opening in the commercial trash bin lid.

35. A commercial trash bin lid assembly as defined in claim 27, wherein at least one said insert members is adapted to fully close said opening and wherein said assembly includes arrangements for fixedly securing said insert member to said lid so that said opening remains closed during normal use of said lid.

36. A commercial trash bin lid assembly as defined in claim 27, wherein at least one of said insert members is substantially flat and elongated.

37. A method of converting a commercial trash bin lid quickly and inexpensively without removing the lid from the container comprising the steps of:

preparing a convertible commercial trash bin lid comprising:

a commercial trash bin lid having a standard-sized opening;

said lid having an extent of at least approximately three feet in at least one direction; and a plurality of interchangeable insert members of different configurations, each of which is adapted to be individually fitted to said lid to at least partially close said standard-sized opening;

adapting said lid for use in recycling a first type of recyclable material by fitting a first one of said interchangeable members to said lid to at least partially close said standard-sized opening; and converting said lid quickly and inexpensively without removing the lid from the container by removing the first member and replacing it with a second member, for use in recycling an entirely different recyclable commodity.

* * * * *